US006166491A

United States Patent [19]

Tsuchiya et al.

[11] Patent Number: 6,166,491

[45] Date of Patent: Dec. 26, 2000

[54] LIGHTING DEVICE AND DISPLAY EQUIPMENT

[75] Inventors: Ryuji Tsuchiya; Naoki Tsutsui; Yuji Wagatsuma; Yoshinori Sato; Takao Mizukami, all of Kanagawa-ken, Japan

[73] Assignee: Toshiba Lighting & Technology Corporation, Tokyo, Japan

[21] Appl. No.: 09/324,763

[22] Filed: Jun. 3, 1999

[30] Foreign Application Priority Data

Jun. 4, 1998 [JP] Japan ..... 10-156272
Dec. 28, 1998 [JP] Japan ..... 10-374015

[51] Int. Cl.[7] ..... G09G 3/10

[52] U.S. Cl. ..... 315/169.3; 315/157; 315/158

[58] Field of Search ..... 315/169.3, 158, 315/157, 291, 309, 307, 326, DIG. 4, DIG. 7; 313/8, 325; 362/216

[56] References Cited

U.S. PATENT DOCUMENTS

| | | | |
|---|---|---|---|
| 4,344,018 | 8/1982 | Inada | 315/47 |
| 4,387,067 | 6/1983 | Kobayashi et al. | 264/63 |
| 4,398,123 | 8/1983 | Tsuchihashi et al. | 315/46 |
| 5,187,416 | 2/1993 | Bazin | 315/73 |
| 5,723,951 | 3/1998 | Byszewski et al. | 315/174 |
| 5,907,222 | 5/1999 | Lengyel et al. | 315/309 |
| 5,951,145 | 9/1999 | Iwasaki et al. | 362/216 |
| 5,955,846 | 9/1999 | Kominami et al. | 315/DIG. 7 |

*Primary Examiner*—Don Wong
*Assistant Examiner*—Thuy Vinh Tran
*Attorney, Agent, or Firm*—Pillsbury Madison & Sutro LLP

[57] ABSTRACT

A lighting device controls power to a discharge lamp according to the temperature detected by a lamp sensor, which detects temperature around the discharge lamp. The discharge lamp has an arc tube and an outer bulb between which an airtight space is defined. Therefore, the lamp can be actuated without reduction in luminosity even at low temperatures. Also, the lamp luminosity rises quickly.

10 Claims, 11 Drawing Sheets

LIGHTING DEVICE AND DISPLAY EQUIPMENT

INCORPORATION BY REFERENCE

This application claims priority from Japanese Patent Applications 10-374015 filed Dec. 28, 1998 and 10-156272 filed Jun. 4, 1998, the contents of which are incorporated herein by reference.

BACKGROUND OF THE INVENTION

1. Field of the Invention

The present invention relates to a lighting device and a display equipment which uses a low-pressure mercury vapor discharge lamp.

2. Description of Related Art

Using a low-pressure mercury vapor discharge lamp as a lighting device and in display equipment is known. Generally, in such lamps, the mercury vapor pressure becomes low and luminescence efficiency will decrease under low temperature conditions. In fact, luminosity can fall to 10% or less as compared to operation at normal temperatures.

To overcome this problem, it has been known to attach a heater to the discharge lamp in order to heat the lamp before it is energized. However, the cost of the heater is high and causes the equipment to become large.

As an alternative solution, a lamp which prevents luminosity from falling at low temperatures, is disclosed in Japanese Utility Model Patent Publication 4-52932. This lamp uses a dual tube arrangement, having an outer bulb and an inner bulb. The inner bulb defines a discharge space therein. Since the outer bulb insulates the inner bulb, luminescence efficiency does not fall as much as without the outer bulb in low-temperature environments. However, the extent to which the outer bulb can maintain the luminescence efficiency in low-temperature environments is limited. Luminescence efficiency is lower than the lamp which does not include the outer bulb, but instead has a heater. Moreover, even when a heater is attached to the outer bulb in a dual bulb arrangement, the heat of the heater is not transmitted to within the inner bulb.

Japanese Patent Laid-open No.7-272888 shows a lighting device which raises the lamp voltage when the temperature around the bulb of a single tube, cold cathode fluorescent lamp is low. However, because this technology employs a single tube, heat dissipation from the bulb is large. Therefore, even when the lamp voltage goes up, the temperature of the lamp does not rise effectively.

SUMMARY OF THE INVENTION

Accordingly, an object of the present invention is to provide a lighting device and display equipment which can prevent the fall of luminosity under low temperature conditions.

The lighting device has a discharge lamp lighting equipment which controls the power provided to the lamp according to the temperature detected by a lamp sensor which detects the temperature around the discharge lamp.

The discharge lamp has an arc tube filled with mercury and a rare gas and in which electrodes are fixed. The lamp also includes an outer bulb which surrounds the arc tube and seals it in an airtight manner.

Therefore, the light can be switched on, and its luminosity will not be reduced even when the temperature around the lamp is low. Even at low temperatures, the luminosity will increase quickly to a desired value.

BRIEF DESCRIPTION OF THE DRAWINGS

Various embodiments of the invention will be described in more detail below, with reference to the following figures.

Throughout the various figures, like reference numerals designate like or corresponding parts or elements. Duplicative description will be avoided as much as possible.

DETAILED DESCRIPTION OF THE PREFERRED EMBODIMENTS

Figure 1:
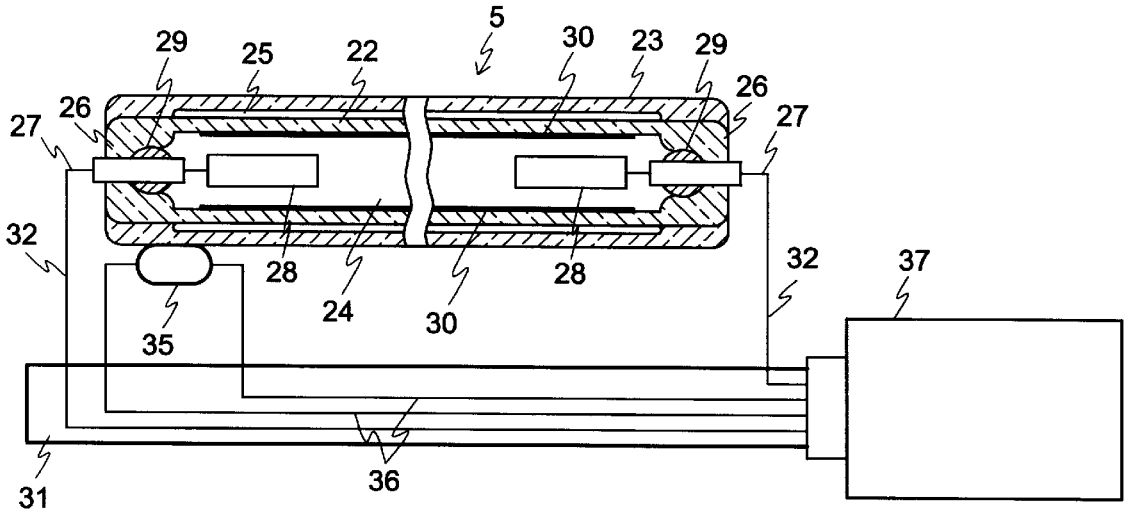
FIG. 1 is a transverse cross section of a first embodiment of the low-pressure mercury vapor discharge lamp of the lighting device of the present invention.

Hereafter, the embodiments of the present invention are explained with reference to the drawing.

Figure 3:
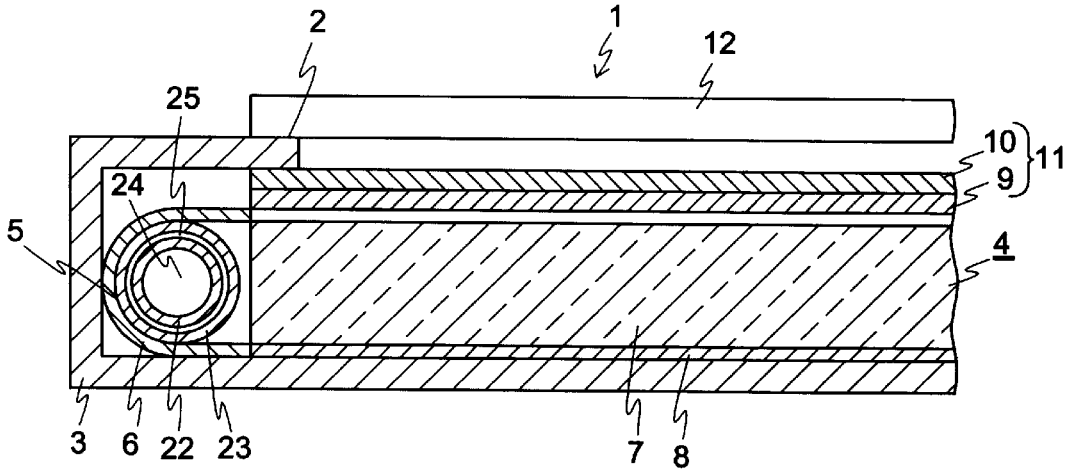
FIG. 3 is a sectional view showing liquid crystal display equipment of the first embodiment of the present invention.

FIG. 3 is a sectional view showing liquid crystal display equipment.

The liquid crystal display equipment I includes a front case 3 that has an aperture 2 through which light is emitted. Case 3 includes a back light unit 4 which has a low-pressure mercury vapor discharge lamp 5. A reflective mirror is wound around a portion of the low-pressure mercury vapor discharge lamp 5 so that the reflective mirror 6 forms an aperture through which light from the lamp 5 is emitted. The reflective mirror 6 is a silver vapor coating film, and also becomes a proximity conductor.

The lightguide board 7 made from acrylic resin is formed in front of the reflective mirror 6. The lightguide board 7 is coextensive with the aperture 2 of the case 3. A plane-like reflector 8 is behind the lightguide board 7. Between the lightguide board 7 and the aperture 2, a diffusion board 9 and a condensing board 10 form an optical control means 11. A liquid crystal display unit 12 is provided in the front of the aperture 2 as a display means.

Figure 2:
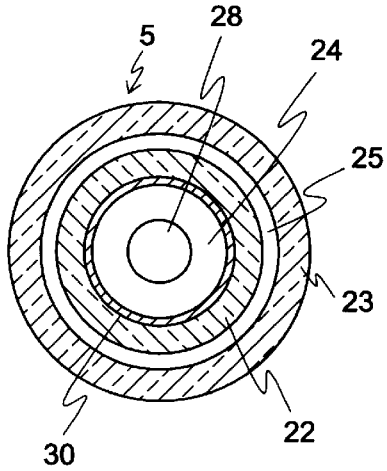
FIG. 2 is a vertical section view showing the low-pressure mercury vapor discharge lamp of the first embodiment of the present invention.

FIG. 1 is a cross section of the lighting device that includes the low-pressure mercury vapor discharge lamp. FIG. 2 is a vertical section view of the low-pressure mercury vapor discharge lamp. Since FIGS. 1 and 2 are conceptual, the form and size in the Figures are not exact.

The low-pressure mercury vapor discharge lamp 5 has a straight, elongated, inner bulb in the form of arc tube 22. An outer bulb 23 is attached to and conforms to the shape of the arc tube 22 and has the same axis. The outer bulb 23 is sealed to the arc tube 22 at both ends of the arc tube 22. A discharge gap 24 is formed in the arc tube 22. Airtight space 25 is formed between the arc tube 22 and the outer bulb 23, and ends 26 of the arc tube 22 and the outer bulb 23 are sealed. The arc tube 22 and the outer bulb 23 consist of borosilicate glass, such as product number 7050 of CORNING Co. This glass has a coefficient of thermal expansion of $46\times10^{-7}$ m/° C. Soda lead glass, soda lime glass, lead glass, and hard glass can be used to form the arc tube 22 and/or the outer bulb 23.

Each lead wire 27 extends through one of ends 26 of the arc tube 22 through a bead of glass 29. The lead wires 27 are made from cobalt alloys (Fe—Ni—Co). The length of each sealed end 26 is 2 mm. The length of sealed end 26 is preferably 5 mm or less. When the length is short, heat is conducted well from cold cathodes 28 to the arc tube 22, so that the end of arc tube 22 is generally kept hot, so that the efficiency of the discharge lamp is typically maintained.

Each pipe-like cold cathode 28 is attached to one of the lead wires 27. The cold cathodes 28 are made from nickel. More specifically, the cold cathode 28 has mercury amalgam in the sleeve of nickel stainless steel (SUS). $BaAl_2O_4$ may be attached to the outside of the sleeve. $LiAlO_4$ may also be employed instead of $BaAl_2O_4$. As a further alternative, oxidized forms of tantalum (Ta), tungsten (W), titanium (Ti) or zirconium (Zr) mixed with either lithium (Li) or barium (Ba) can be employed. The cold cathodes 28 may be coated with emitter material which emits secondary electrons by, for example, positive ion bombardment. Examples include $LaSrCoO_3$, $LaB_6+BaAl_2O_4$, $LaSrCoO_3+BaAl_2O_4$, $LaSrCrCoO_3+BaAl_2O_4$, $LaSrCoO_3+LaB_6+BaAl_2O_4$, $LaSrCrCoO_3+LaB_6+BaAl_2O_4$, $LaB_6+BaTiO_3$, $LaSrCoO_3+BaTiO_3$, $LaSrCrCoO_3+BaTiO_3$, $LaSrCoO_3+LaB_6+BaTiO_3$, and $LaSrCrCoO_3+LaB_6+BaTiO_3$.

Alpha alumina is provided in the inside of the arc tube 22 near the cold cathode 28. As a result, Exo electrons can be generated, making it easier to cause the lamp to light.

The low-pressure mercury vapor discharge lamp 5 has a rated current of 4 mA. The full length of lamp 5 is 280 mm. In the arc tube 22, the thickness of the glass is 0.3 mm. and the outside diameter is2.2 mm. In the outer bulb 23, the thickness of the glass is 0.3 mm. and the outside diameter is 3.0 mm. The gap 25 between the arc tube 22 and the outer bulb 23 is 0.1 mm.

Xenon (Xe), at a pressure of 133 Pa, is enclosed in the gap 25 between the arc tube 22 and the outer bulb 23. A phosphor layer 30 is applied to the inside of the arc tube 22. The phosphor layer 30 emits three wavelengths. For example, Blue light is emitted by $(SrCaBa)_5(PO_4)_3Cl$:Eu. Green light is emitted by $LaPO_4$:Ce,Tb. Red light is emitted by $Y_2O_3$:Eu.

In the arc tube 22, the discharge medium is at a pressure of 10.6 kPa. The discharge medium includes mercury and a mixed gas having neon (Ne) 90% and argon (Ar) 10%. The inner surface area S of the arc tube is 10 $cm^2$.

Furthermore, the lead wire 27 is connected to wiring 32 formed in a flexible printed circuit board 31. A temperature sensing thermistor 35 contacts the outer bulb 23. The thermistor 35 connects with wiring 36 provided in the flexible printed circuit board 31. The flexible printed circuit board 31 is connected to discharge lamp lighting equipment 37.

Figure 4:
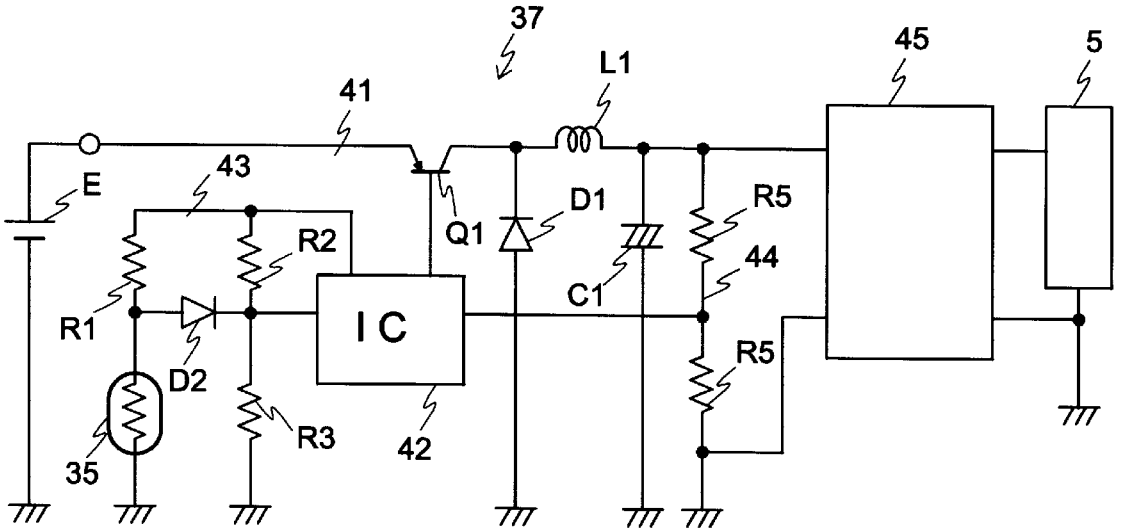
FIG. 4 is a circuit diagram showing the discharge lamp lighting equipment of the first embodiment of the present invention.

As illustrated in FIG. 4, the discharge lamp lighting equipment 37 includes a step-up chopper circuit 41 connected to DC power supply E. The step-up chopper circuit 41 includes a series circuit of a transistor Q1 and a diode D1 connected to DC power supply E. A series circuit of an inductor L1 and a capacitor C1 is connected to the diode D1. Integrated circuit 42 is connected to the base of the transistor Q1. A temperature detection circuit 43 which includes resistor R1, the thermistor 35, resistor R2, resistor R3, and diode D2 is connected to integrated circuit 42. The integrated circuit 42 controls the transistor Q1 to control the current supplied to lamp 5. The integrated circuit 42 includes a processor which controls transistor Q1 based on the temperature initially detected by thermistor 35 at the time that the lamp is lit, the length of time that passes from the moment that the lamp is lit, and, optionally, the temperature detected by thermistor 35 after the lamp is lit and begins to heat up. Various examples of how to relate these temperatures and time will be described in more detail below. An output detection circuit 44, including a series circuit of resistors R5 and R6 is connected in parallel to capacitor C1. An inverter circuit 45 is connected to the step-up chopper circuit 41. Lamp 5 is connected to the inverter circuit 45.

In operation, the discharge lamp lighting equipment 37 applies a voltage to the cold cathodes 28, causing lamp 5 to light. The mercury is vaporized by the discharge between cold cathodes 28, and ultraviolet radiation is emitted at a wavelength of 254 nm. The phosphors 30 emit light, which is reflected by reflective mirror 6 in the direction of the lightguide board 7. Therefore, the lightguide board 7 emits light. Light enters the liquid crystal display unit 12 at the back through the diffusion board 9 and the condensing board 10.

The step-up chopper circuit 41 increases the voltage from DC power supply E, and the inverter circuit 45 changes the DC voltage into a high frequency voltage. This high frequency voltage from the discharge lamp lighting equipment 37 is applied to the low-pressure mercury vapor discharge lamp 5 to energize the lamp.

Figure 5:
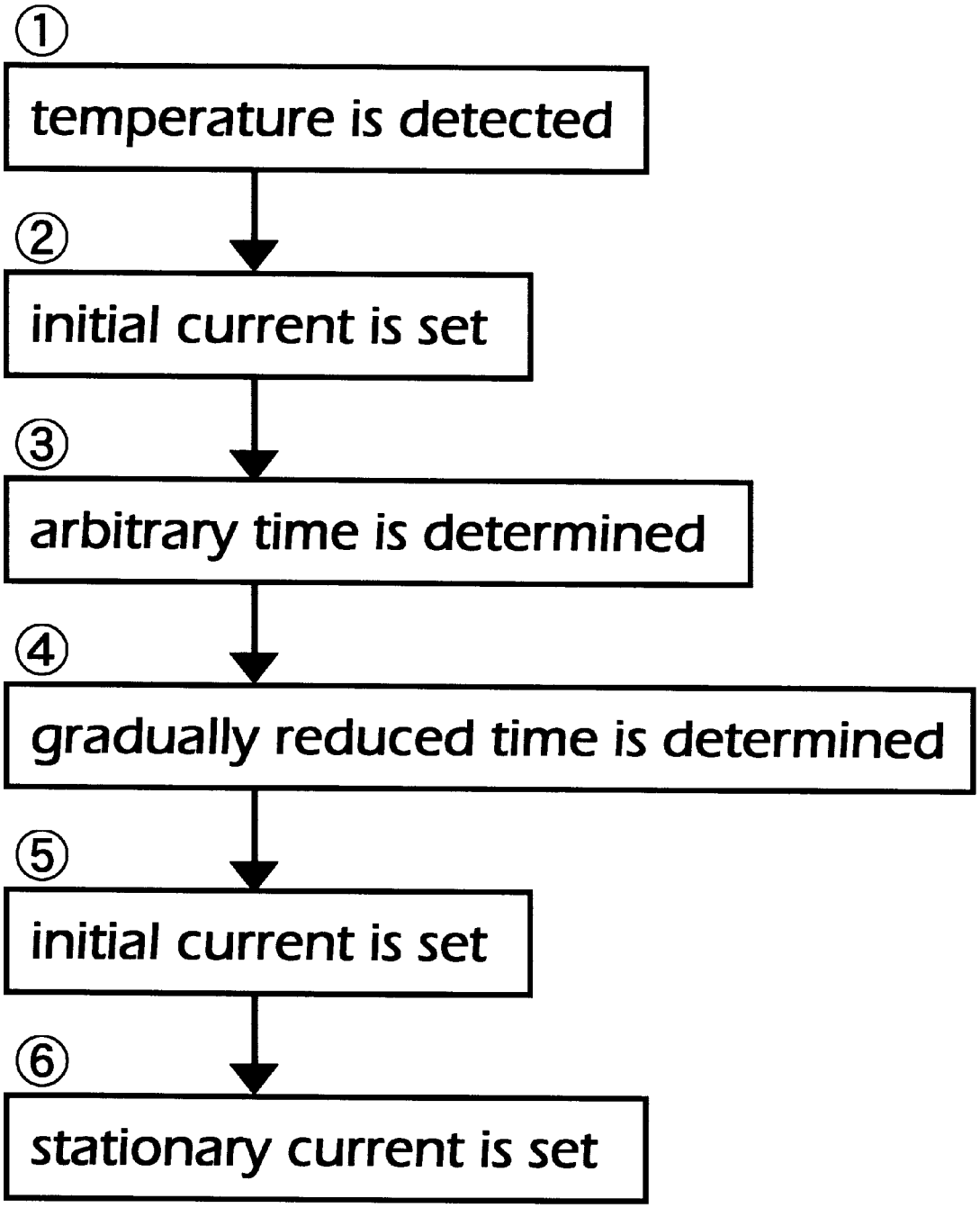
FIG. 5 is a flow chart that shows the operation of the discharge lamp lighting equipment of the first embodiment of the present invention.

FIG. 5 is the flow chart showing the operation of the first embodiment. Before current is applied, the temperature around the low-pressure mercury vapor discharge lamp 5 is detected by the thermistor 35 (Block 1). When the temperature detected by the thermistor 35 is 10 degrees or less, the initial current applied to the lamp is set to a current value higher than the rated current of 4 mA. For example, the initial current can be set dependent on the temperature, or the initial current can be set to an arbitrary current value such as 6 mA (Block 2). An arbitrary time for maintaining the current value above the rated value from the start of lighting is determined, for example, as 2 minutes (Block 3).

If the current value supplied to the low-pressure mercury vapor discharge lamp 5 is reduced abruptly, lamp 5 will lose luminosity suddenly. Therefore, for moderately cold initial temperatures (−30 to −10 degrees C.), the current can be gradually reduced to the rated value. The reduction can follow a logarithmic curve. The time over which the current is reduced is determined in Block 4.

Figure 6:
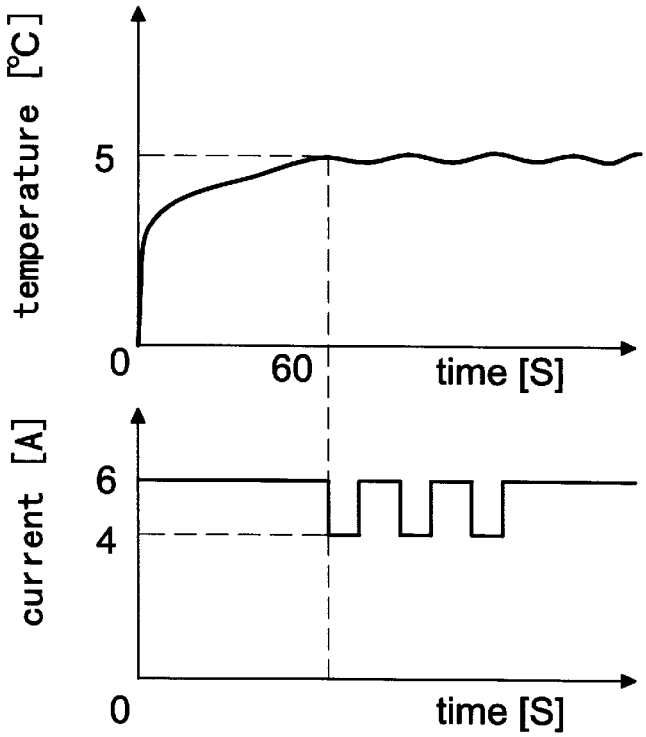
FIG. 6 is a graph illustrating the relationship between tube temperature and current flowing through the tube at an ambient temperature of −30 degrees C., in the first embodiment of the present invention.

When the temperature detected by the thermistor 35 is 10 degrees C or less, during an initial period minutes after lamp 5 is lit, the output current is set to a value higher than the rated value. After the predetermined time passes, the current value is reduced to the rated, stationary current value. For example, when the initial temperature around the lamp is −30 degrees or less, the current value is adjusted as shown in FIG. 6. For the first 60 seconds that the lamp is lit, the current is maintained at a value of 6 mA. Then, for the next 60 seconds, the current is feedback controlled to cause the current to alternate between the 6 and 4 mA values. When the temperature around the lamp is less than a threshold temperature (5 degrees C in FIG. 6), the higher current value is supplied. When the detected temperature rises above the threshold, the current is reduced to the lower value. Since the temperature around the lamp falls quickly when the initial temperature around the lamp is at or less than −30 degrees, the current value is changed abruptly.

Figure 7:
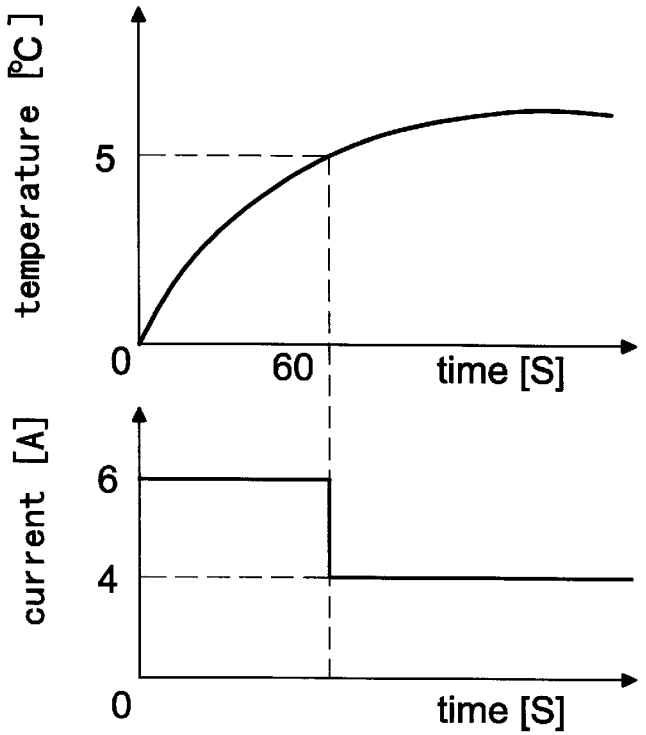
FIG. 7 is a graph illustrating the relationship between tube temperature and current flowing through the tube at an ambient temperature of −10 degrees C., in the first embodiment of the present invention.

When the temperature around the lamp is greater than −10, after the temperature rises to the threshold, the temperature does not fall even when the current is reduced to the rated value. Therefore, the current can be reduced abruptly as illustrated in FIG. 7.

Figure 8:
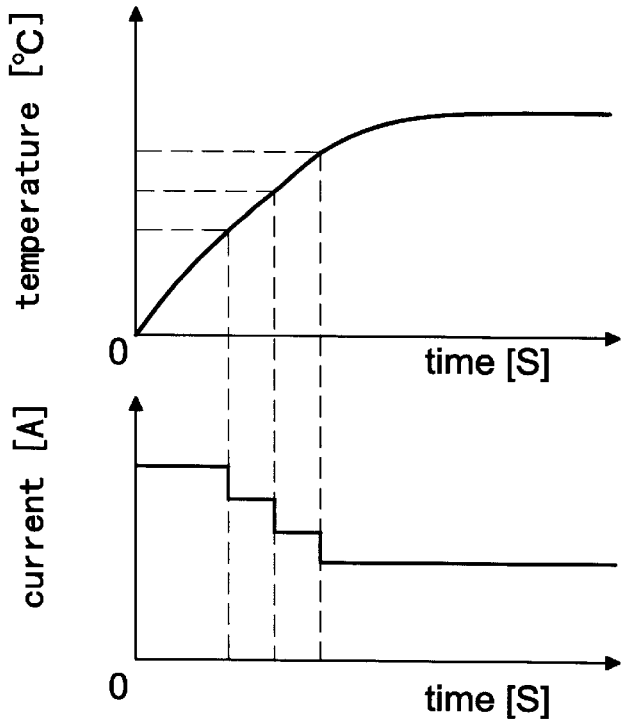
FIG. 8 is a graph illustrating the relationship between tube temperature and current flowing through the tube in the first embodiment of the present invention.

If the thermistor 35 of the low-pressure mercury vapor discharge lamp 5 detects a predetermined value corresponding to a high temerature, for example, 50 degrees C or more, the discharge lamp lighting equipment 37 may gradually reduce the current as shown in FIG. 8, in order to decrease the power supplied to the low-pressure mercury vapor discharge lamp 5.

Figure 9:
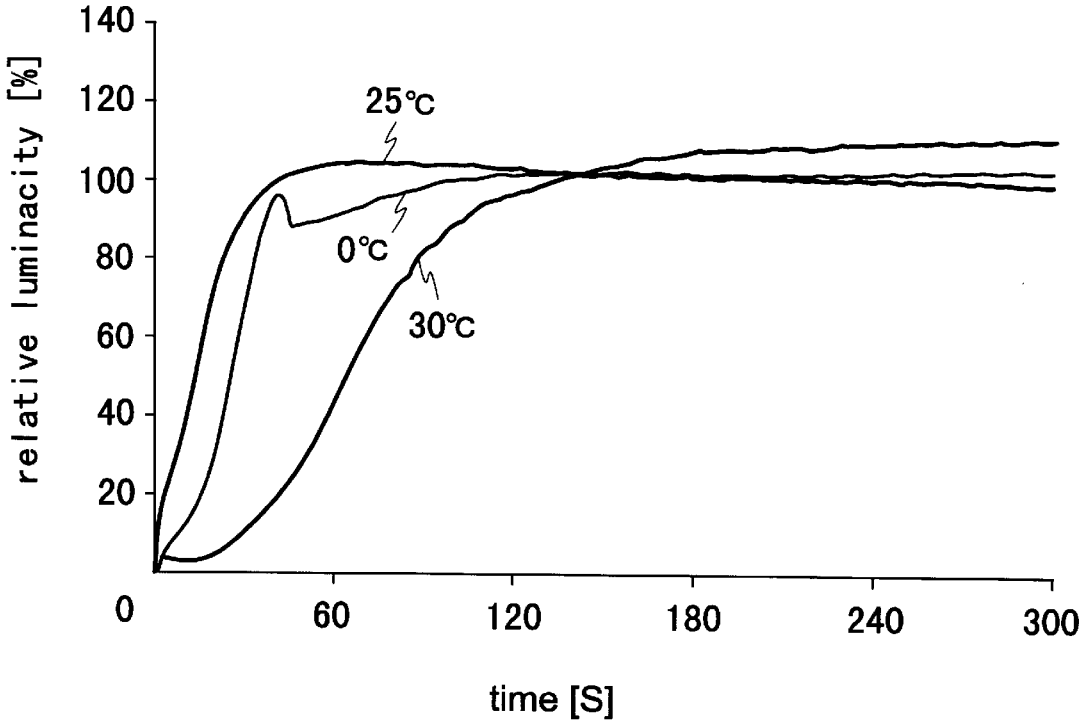
FIG. 9 is a graph illustrating the relationship between relative luminosity and time at different ambient temperatures in the first embodiment of the present invention.

FIG. 9 illustrates luminosity over time for three different initial temperatures around the lamp. Note that for all three temperatures, luminosity rises quickly and achieves 100 percent luminosity within 120 seconds. When the temperature around the lamp is 25 degrees C, 100 percent luminosity is achieved within 60 seconds. In FIG. 9, 100 percent luminosity is defined as the luminosity of lamp 5 after 5 minutes when the initial temperature around the lamp is 25 degrees C.

Figure 10:
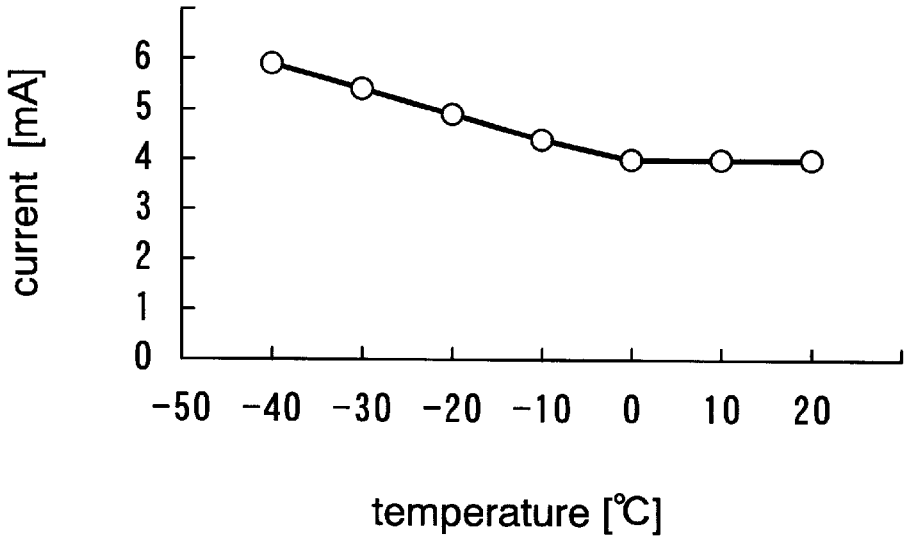
FIG. 10 is a graph illustrating the relationship between lamp current and ambient temperature in the first embodiment of the present invention.
Figure 11:
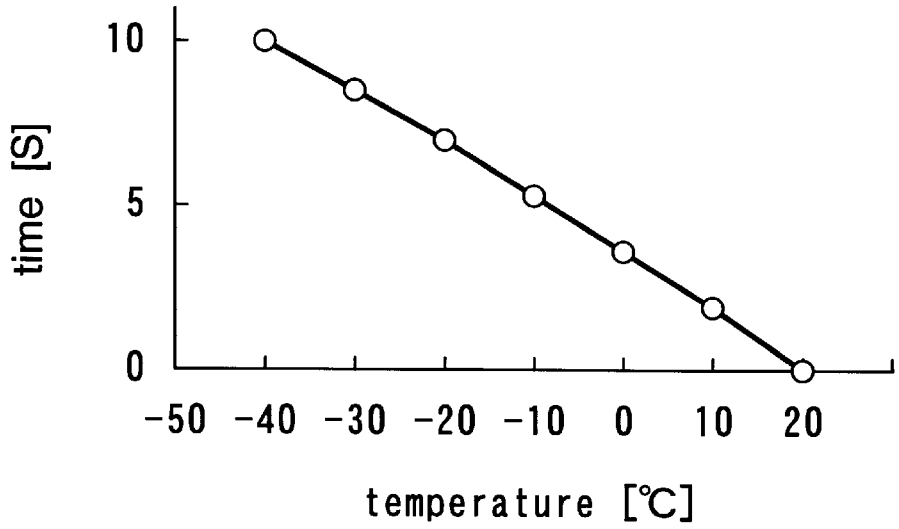
FIG. 11 is a graph illustrating the length of time that high current is provided to the lamp in relation to the initially detected temperature around the lamp in the first embodiment of the present invention.
Figure 12:
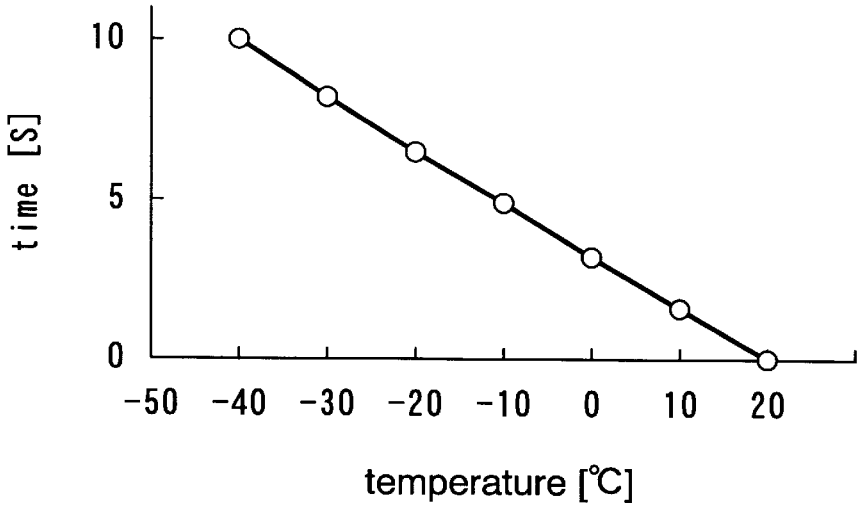
FIG. 12 is a graph illustrating the time over which the current is decreased to the rated current in relation to the initially detected temperature around the lamp in the first embodiment of the present invention.

As suggested above, it is possible to vary the initial current value in relation to the initially detected temperature. FIG. 10 illustrates one possible implementation. As an alternative or in addition, it is also possible to vary the length of time that the larger initial current is supplied to the lamp in relation to the initially detected temperature. FIG. 11 illustrates one implementation. As an alternative or in addition, it is possible to vary the length of time over which the current is reduced from the initial, high value to the rated value in relation to the initially detected temperature. Such an implementation is illustrated in FIG. 12.

According to experiments, results are poor if the current supplied to the lamp does not change with the temperature around the lamp when the initial detected temperature is around −30 degrees C. Luminosity is less than 57% of the maximum at the time of stability. However if the initial current is set to 1.5 times the rated current, luminosity reaches 90 percent of the maximum value at the time that stability is reached in 60 seconds. Even though the lamp current is returned to its rated value after 2 minutes from the start of lighting, luminosity remained at 90 percent as a result of the double structure of the low-pressure mercury vapor discharge lamp 5 and self-heating of the lamp.

The mercury vapor pressure in the arc tube 22 becomes too great when the initial detected temperature is 85 degrees C or greater. As a result, the luminosity is only 58% at the time of stability. The temperature of the upper part of the cold cathode 28 of the arc tube 22 becomes 120 degrees C. If the lamp current is set to 3 mA, the amount of self-heating of the cold cathode 28 will fall, and the temperature of the upper surface will fall to 110 degrees C. Therefore, the rise in mercury vapor pressure is suppressed and luminosity goes up.

If a conductive layer is provided on the outside of the outer bulb 23 to reduce the starting voltage, and if the conductive layer is transparent, the efficiency of the low-pressure mercury vapor discharge lamp 5 is increased. A reflective portion of the conductive layer can be used as the reflective mirror 6. However, the reflective mirror 6 does not need to be conductive. A synthetic film or plastic is sufficient.

The arc tube 22 and the outer bulb 23 do not need to be made of the same material.

The thermistor 35 may be provided in the sealed end 26 of the low-pressure mercury vapor discharge lamp 5. With this arrangement, the temperature of the arc tube 22 is easily conducted to the sealed end 26.

The initial high current need not be decreased to the rated current along a continuous curve. Instead, the current can be reduced in steps.

Figure 13:
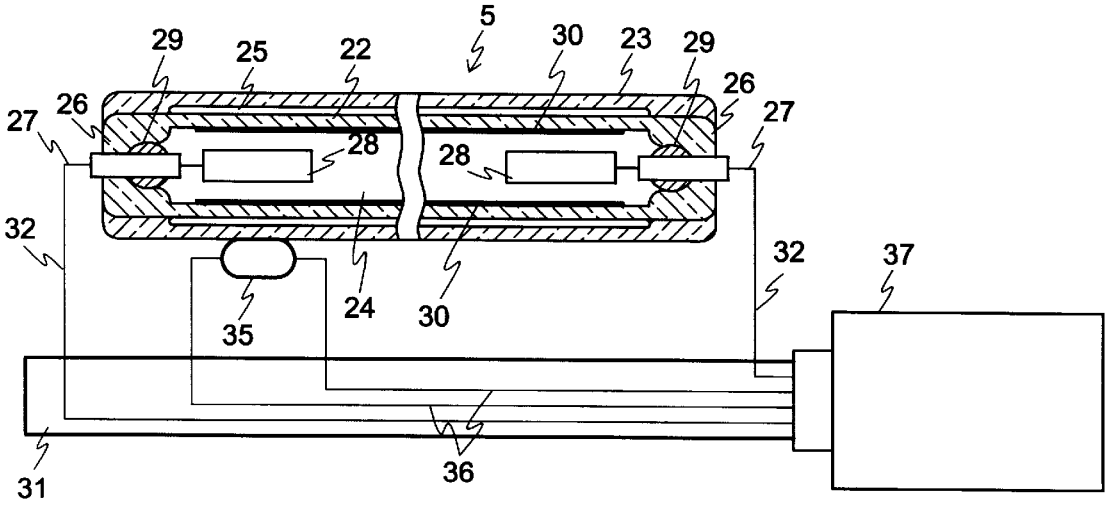
FIG. 13 is a transverse cross section of a second embodiment of the low-pressure mercury vapor discharge lamp of the lighting device of the present invention.

FIG. 13 is a sectional view showing the lighting device of a second embodiment of the invention. In this embodiment, the thermistor 35 is provided on the outer bulb 23 near the cold cathode 28 rather than near the end of the outer bulb 23 as in FIG. 1. Since the heat of the cold cathode 28 is easily detectable if the thermistor 35 is positioned close to the cold cathode 28, the supply power of the low-pressure mercury vapor discharge lamp 5 can be adjusted according to temperature change of the arc tube 22.

Figure 14:
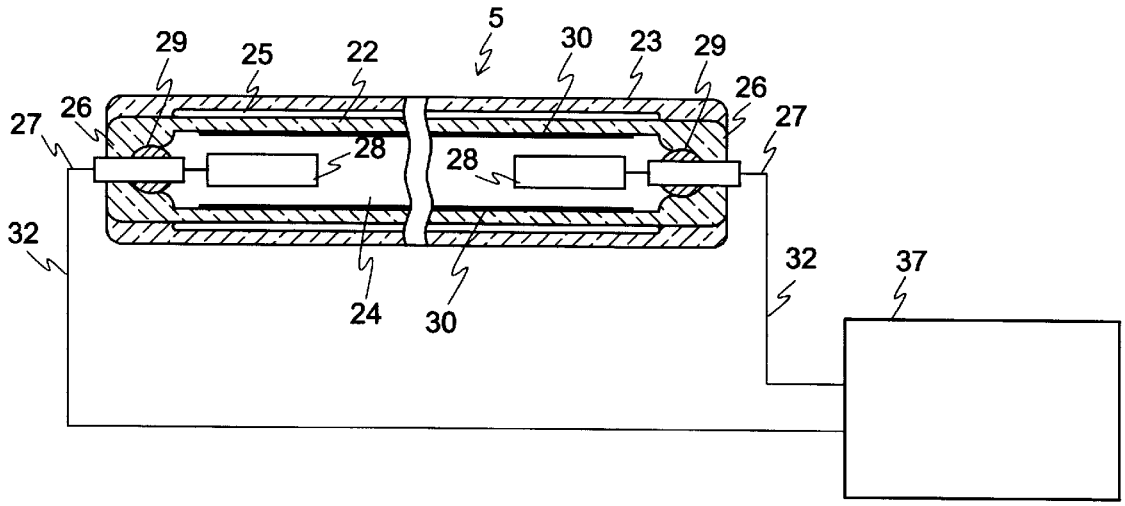
FIG. 14 is a transverse cross section of a third embodiment of the low-pressure mercury vapor discharge lamp of the lighting device of the present invention.

FIG. 14 is a sectional view showing the lighting device of a third embodiment of the invention. The thermistor 35 is contained within the discharge lamp lighting equipment 37. In this case, the temperature of the low-pressure mercury vapor discharge lamp 5 is indirectly detectable by detecting the temperature of the discharge lamp lighting equipment 37. Since the wiring to the thermistor 35 is not needed, the printed circuit board 31 becomes unnecessary.

Figure 15:
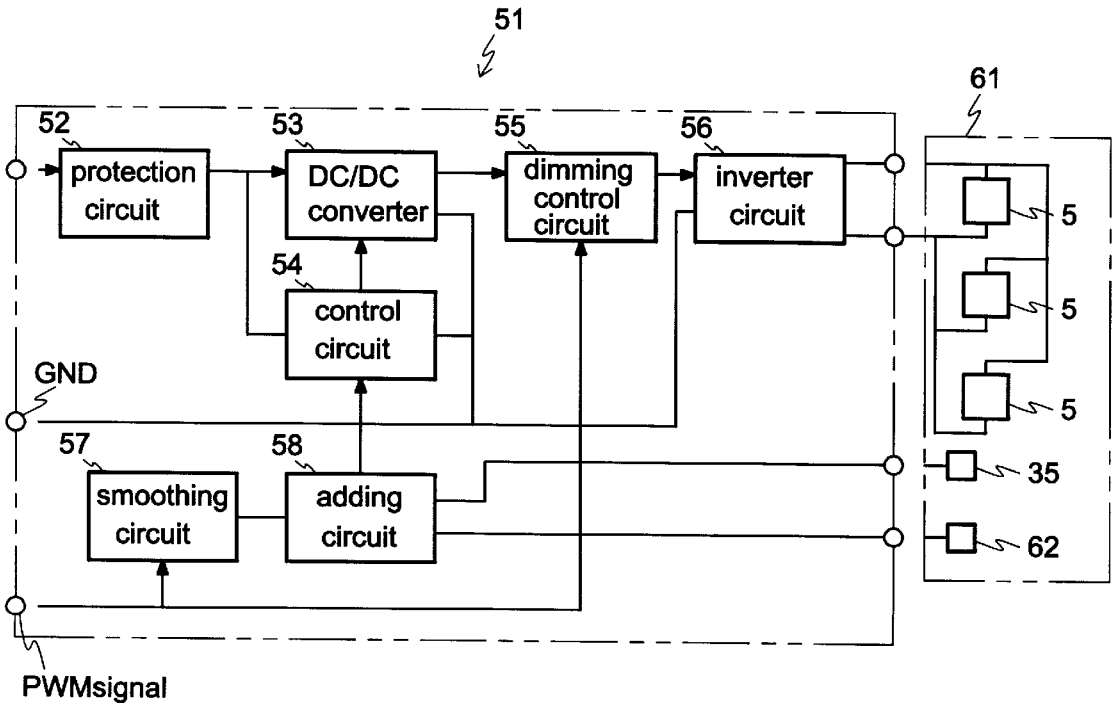
FIG. 15 is a block diagram showing a fourth embodiment of a discharge lamp lighting equipment of the lighting device of the present invention.

FIG. 15 is a block diagram showing the discharge lamp lighting equipment of a fourth embodiment of the invention. A protection circuit 52 is connected to the power supply and protects the lamp lighting control circuit 51 from excessive and reverse voltages. A DC/DC converter 53 changes the voltage value from the protection circuit 52. The DC/DC converter 53 is controlled by a control circuit 54, which controls the current provided to lamps 5, and increases the time that a high current is provided to the lamps 5. The DC/DC converter 53 is connected to an inverter circuit 56 through a conventional dimming control circuit 55 which controls dimming of the low-pressure mercury vapor discharge lamp 5 in accordance with a pulse width modulated (PWM) signal. The PWM signal is connected to the control circuit 54 through a smoothing circuit 57 and an addition circuit 58. As will be explained in greater detail below, during dimming, it is desirable to increase the initial current value and/or extend the time that increased current is provided to lamps 5. This is accomplished by the PWM signal through the smoothing circuit57 and the adding circuit 58.

Lamp assembly 61 is connected to lamp lighting control circuit 51. Three low-pressure mercury vapor discharge lamps 5 are connected in parallel to the inverter circuit 56 to increase the amount of light provided. Two thermistors 35 and 62 are provided in the lamp assembly 61 to monitor the temperature around lamps 5 at two different locations. The greater detected temperature is employed to control the increased current at the start of illumination and the length of time that increased current is provided. The thermistors 35 and 62 are connected to the addition circuit 58 which selects the greater value and adds that value to the smoothed PWM signal. The control circuit 54 includes a processor which controls DC/DC converter 53 based on the output of addition circuit 58 at the time that the lamp is lit, the length of time that passes from the moment that the lamp is lit, and, optionally, the output of the addition circuit 58 after the lamp is lit and begins to heat up. Various examples of how to relate these temperatures and time will be described in more detail below and have been described above.

Figure 16:
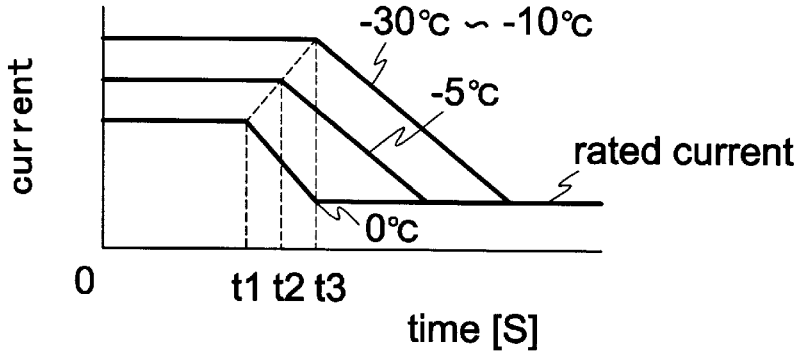
FIG. 16 is a graph that shows a first possible relationship between driving current and time in the fourth embodiment of the present invention.

The operation of the circuit in FIG. 15 is similar to that of FIG. 4. The output current of the inverter circuit 56 is related to the output voltage of the DC/DC converter 53. FIG. 16 illustrates one manner of operating the circuit of FIG. 15. In this embodiment, the initial current value is related to the initial detected temperature. FIG. 16 illustrates the relation between current supplied to lamps 5 and time for several temperatures initially detected around lamps 5. For example, when thermistor 35 or 62 (whichever is greater) initially detects a temperature of 0 degrees C., the initial current is set to a relatively low value from the start of lighting until a time t1 which can be 50 seconds. When the initial temperature detected by thermistor 35 or 62 is −5 degrees C., the initial current is set to a higher level from the start of lighting until a time t2 which can be 70 seconds. When thermistor 35 or 62 detects an initial temperature in the range of −30 degrees to −10 degrees C., a relatively higher initial current is supplied from the start of lighting until a time t3 which can be increased current is provided is set as 90 seconds. The initial current, larger than rated current, is provided for longer times as the temperature becomes lower. In addition, the initial current value is selected, based on the initial detected temperature. The rate of reduction of the initially high current to the rated current is the same, independent of the initially detected temperature. Since a larger initial current is provided and the time that the larger current is provided is lengthened as the initial detected temperature becomes lower, the rise of the lamp's luminosity can be made quick even at low temperatures. Moreover, for low temperatures below −10 degrees C., the initial current is not increased any further. Therefore, it is not necessary to supply an exceptionally large current. Therefore, the capacity of the power supply does not need to be enlarged.

Figure 17:
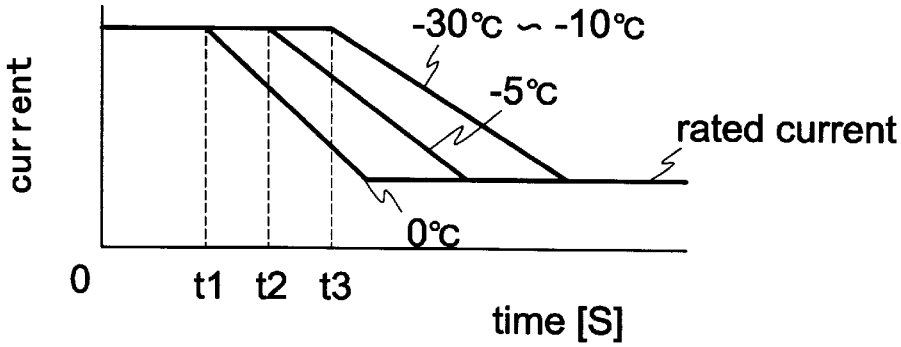
FIG. 17 is a graph that shows a second possible relationship between driving current and time in the fourth embodiment of the present invention.

An alternative manner of controlling lamps 5 is illustrated in FIG. 17. As with FIG. 16, FIG. 17 illustrates the relation of current to time at several initially detected temperatures. When thermistor 35 or 62 (whichever is greater) initially detects a temperature of 0 degrees C., a time t1 during which an increased current is provided is set as 60 seconds. When the initial temperature detected by thermistor 35 or 62 is −5 degrees C., a time t2 during which an increased current is provided is set as 90 seconds. When thermistor 35 or 62 detects an initial temperature in the range of −30 degrees to −10 degrees C., a time t3 during which an increased current is provided is set as 120 seconds. The initial current, larger than rated current, is provided for longer times as the temperature becomes lower. The initial, higher, current value is set the same, independent of the initial detected temperature. Since a larger initial current is provided and the time that the larger current is provided is lengthened as the initial detected temperature becomes lower, the rise of the lamp's luminosity can be made quick even at low temperatures. Moreover, since only the time at the higher current is changed, and not the current value itself, the need for an exceptionally large current supply is avoided.

Figure 18:
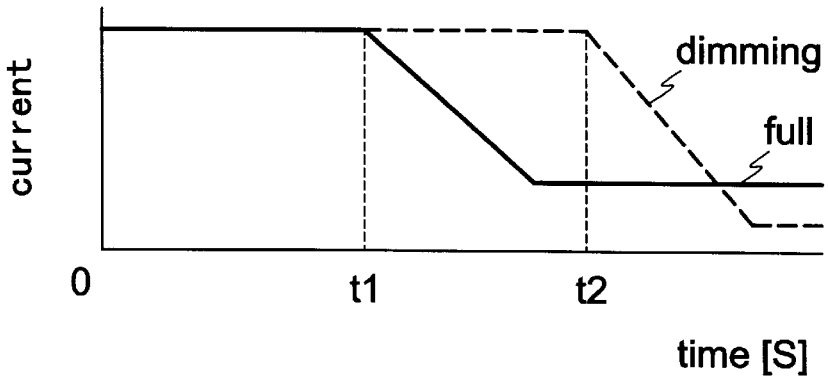
FIG. 18 is a graph that shows a third possible relationship between driving current and time in the fourth embodiment of the present invention.

FIG. 18 illustrates the operation of an embodiment that includes a dimming feature. A high initial current value, larger than the rated current, is supplied to lamps 5 whether the lamps are being dimmed or are on continuously. The length of time that the higher current is provided to the lamp is extended when the lamp is dimmed. The rate of reduction of the current from the higher current to the rated current is the same. Thus since dimming causes the lamp to remain cool longer, raising the current for a longer period of time causes the luminosity to rise to the desired level quickly, even during dimming.

Figure 19:
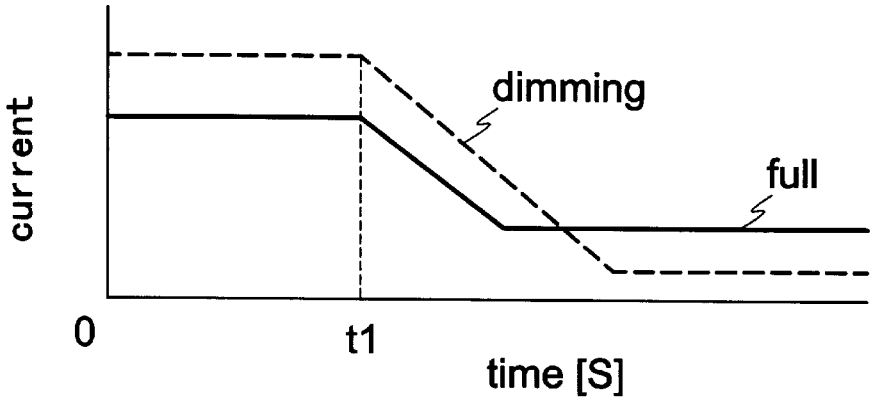
FIG. 19 is a graph that shows a fourth possible relationship between driving current and time in the fourth embodiment of the present invention.

An alternative embodiment incorporating dimming is illustrated in FIG. 19. In FIG. 19, the initial current used for dimming is higher than the initial current used for full lighting. The initial high current is gradually reduced from the same point in time and at the same rate. Thus since a higher initial current is employed for dimming, the rise of luminosity to the desired value is quick even though dimming is occurring.

Figure 20:
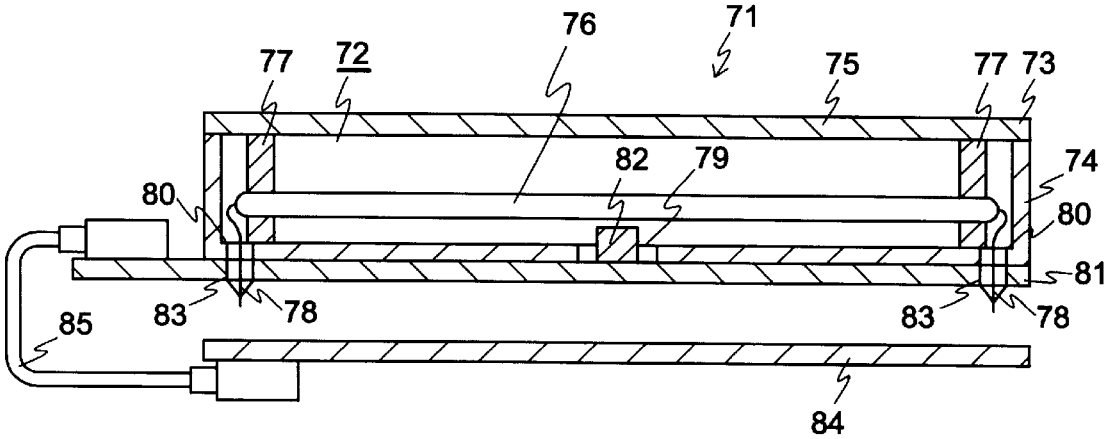
FIG. 20 is a sectional view showing a fifth embodiment of the display equipment which is particularly suited for use in vehicles.

FIG. 20 is a sectional view of a fifth embodiment of the invention which is particularly suited for vehicles. A reflector 74, in the shape of a thin box forms a housing of the back light unit 72 and defines an aperture 73 therein. The aperture 73 of the reflector 74 is airtightly covered with a diffusion board 75. Rubber holders 77 fix a low-pressure mercury vapor discharge lamp 76 between the reflector 74 and the diffusion board 75. Lead wires 78 are attached in the low-pressure mercury vapor discharge lamp 76. The front of the diffusion board 75 is equipped with a vehicle meter (not illustrated). An aperture 79 and a lead wire hole 80 are formed on the back side of the reflector 74.

A connector board 81 is attached in the back side of the reflector 74. The low-pressure mercury vapor discharge lamp 76 is electrically connected to the connector board 81. A thermistor 82 is also attached to the printed circuit board. The thermistor 82 extends through the aperture 79 of the reflector 74 and detects the temperature around the low-pressure mercury vapor discharge lamp 76. A hole 83 is formed in the connector board 81, at a position corresponding to each lead wire hole 80 of the reflector 74, to enable the lead wires 78 of the low-pressure mercury vapor discharge lamp 76 to pass. After passing through holes 80 and 83, the lead wires 78 are connected to the connector board 81. A flexible circuit board 84 is connected with the connector board 81 through a cable 85.

Figure 21:
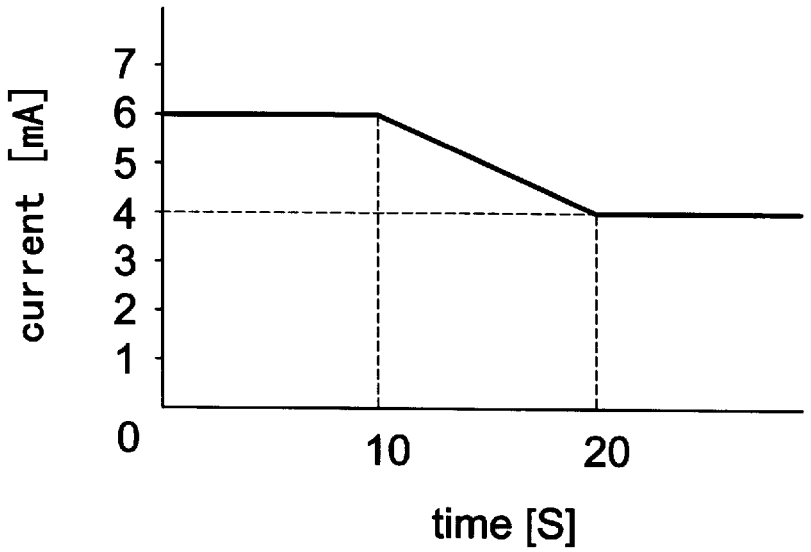
FIG. 21 is a graph that shows the relationship between lamp current and time in the fifth embodiment of the present invention.

In this embodiment, the same low-pressure mercury vapor discharge lamp 5 as in FIG. 1 is used. When thermistor 82 detects a temperature at −40 degrees C. or less, the lamp current is set to 6 mA for 10 minutes from the time that the low-pressure mercury vapor discharge lamp 5 is started, as shown in FIG. 21. After the first 10 minute period, the current value is gradually, linearly reduced over the next 10 minute period to the rated current of 4 mA. At temperatures above −40 degrees C., any of the modes of operation described above may be employed to control the current to the lamp.

Figure 22:
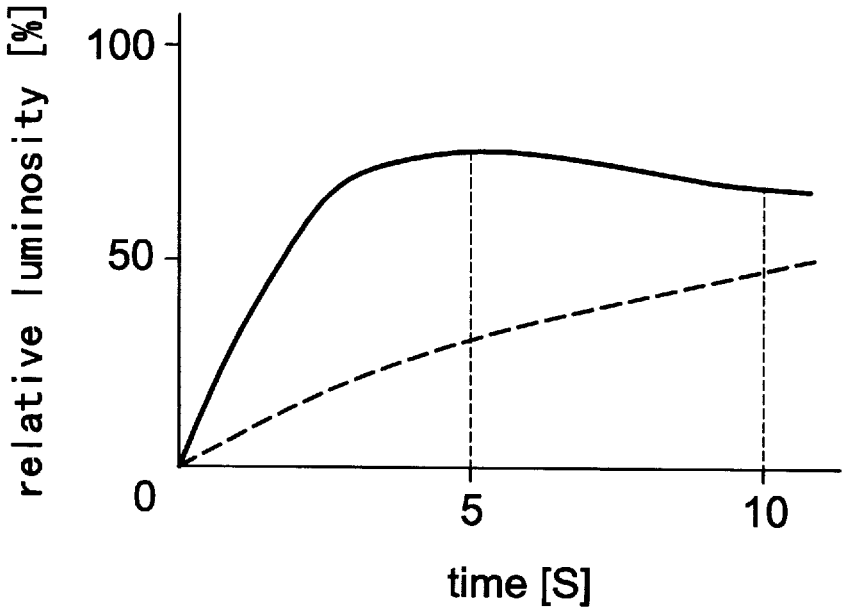
FIG. 22 is a graph that shows the relationship between relative luminosity and time in the fifth embodiment of the present invention.

When the timing of FIG. 21 is employed, the luminance rises as shown in FIG. 22. It can be seen that the low-pressure mercury vapor discharge lamp 5 achieves a relative luminosity of 50% in 1 to 2 minutes after lighting starts. Note that after reaching a peak, the relative luminosity declines a bit. This is not a problem, particularly when compared with the relative luminosity curve when the rated current is applied from the beginning, as shown in FIG. 22 by the dashed line.

Moreover, after 20 minutes from the start of lighting in the environment of a vehicle, the temperature around the lamp will rise with the heat of the flexible circuit board 84 and the engine. Therefore, the lamp operates well even after 20 minutes.

While the invention has been described in connection with what are presently considered to be the most practical and preferred embodiments, it is to be understood that the invention is not limited to the disclosed embodiments. On the contrary, it is intended to cover various modifications and equivalent arrangements included within the spirit and scope of the appended claims.

What is claimed is:

1. A lighting device comprising:

a low mercury vapor discharge lamp including an arc tube fixing cold cathodes and outer tube surrounding the arc tube and an airtight space which insulates heat therebetween;

a lamp sensor which detects temperature around the discharge lamp; and a discharge lamp lighting equipment which controls the lamp power according to the temperature detected by the lamp sensor.

2. A lighting device as set forth in claim 1, further comprising a flexible circuit board which provides wiring for the discharge lamp and the lamp sensor.

3. A lighting device as set forth in claim 1, wherein the lamp sensor is a temperature sensor, and the discharge lamp lighting equipment increases power to the discharge lamp when the temperature detected by the lamp sensor is low.

4. A lighting device as set forth in claim 1, wherein the lamp sensor is a temperature sensor, and the discharge lamp lighting equipment decreases power to the discharge lamp when the temperature detected by the lamp sensor is high.

5. A lighting device as set forth in claim 1, wherein the lamp sensor is a temperature sensor, and the discharge lamp lighting equipment determines and controls power to the discharge lamp at values that are alternately higher and lower according to the temperature detected by the lamp sensor.

6. A lighting device as set forth in claim 1, wherein the temperature sensor is thermally coupled to the discharge lamp.

7. A lighting device as set forth in claim 1, wherein the temperature sensor is located near an electrode of the arc bulb.

8. A lighting device as set forth in claim 1, wherein the temperature sensor is mounted in the discharge lamp lighting equipment.

9. A lighting device comprising:

a discharge lamp including an arc tube and an outer tube surrounding the arc tube and an airtight space therebetween;

a lamp sensor which is a temperature sensor, and the lamp sensor detects temperature around the discharge lamp; and a discharge lamp lighting equipment which controls the lamp power according to the temperature detected by the lamp sensor, and the discharge lamp lighting equipment determines and controls a length of time that lamp power is altered from a rated power based on the temperature detected by lamp sensor at the time the discharge lamp is first lit.

10. A display equipment comprising:

a lighting device; and a display element received light from the lighting device;

the lighting device comprising:

a low mercury vapor discharge lamp including an arc tube fixing cold cathodes and an outer tube surrounding the arc tube and an airtight space which insulates heat therebetween;

a lamp sensor which detects temperature around the discharge lamp; and a discharge lamp lighting equipment which controls the lamp power according to the temperature detected by the lamp sensor.

* * * * *